US006367286B1

(12) United States Patent
Price

(10) Patent No.: US 6,367,286 B1
(45) Date of Patent: Apr. 9, 2002

(54) SYSTEM AND PROCESS FOR LIQUEFYING HIGH PRESSURE NATURAL GAS

(75) Inventor: Brian C. Price, Overland Park, KS (US)

(73) Assignee: Black & Veatch Pritchard, Inc., Overland Park, KS (US)

( * ) Notice: Subject to any disclaimer, the term of this patent is extended or adjusted under 35 U.S.C. 154(b) by 0 days.

(21) Appl. No.: 09/704,064

(22) Filed: Nov. 1, 2000

(51) Int. Cl.[7] ..... F25J 1/00
(52) U.S. Cl. ..... 62/613

(58) Field of Search ..... 62/613, 620, 621, 62/622

(56) References Cited

U.S. PATENT DOCUMENTS 4,033,735 A 7/1977 Swenson ..... 62/9
5,657,643 A 8/1997 Price ..... 62/612

*Primary Examiner*—William Doerrler
*Assistant Examiner*—Malik N. Drake

(57) ABSTRACT

A system and a method for efficiently removing natural gas liquids from a natural gas stream at an elevated pressure and liquefying the natural gas stream at an elevated pressure by use of a turbo expander and a compressor.

23 Claims, 3 Drawing Sheets

SYSTEM AND PROCESS FOR LIQUEFYING HIGH PRESSURE NATURAL GAS

FIELD OF THE INVENTION

This invention relates to a method for efficiently removing natural gas liquids from a natural gas stream at an elevated pressure while liquefying the natural gas stream at an elevated pressure.

BACKGROUND OF THE INVENTION

In recent years the demand for natural gas has increased, particularly in many areas where no natural gas reserves or few natural gas reserves are found. Since many areas have abundant supplies of natural gas it is desirable to be able to transport the natural gas from these areas to market areas. One method for transporting the natural gas is by liquefying the natural gas. Use of liquefied natural gas (LNG) and methods for liquefying natural gas are well known. The natural gas may be liquefied at the point of production or may be liquefied at the point of use when it is available in surplus during portions of the year, i.e., during the summer months when less is required for heating. The natural gas is then readily stored as liquefied natural gas to meet winter peak demand for natural gas in excess of that available through an existing pipeline or the like.

Natural gas is widely used as a fuel and is widely transported as a liquefied natural gas product. The natural gas may be liquefied by a variety of processes, one of which is frequently referred to as a mixed refrigerant process. Such processes are shown, for instance, in U.S. Pat. No. 4,033,735 issued Jul. 5, 1977 to Leonard K. Swenson and in U.S. Pat. No. 5,657,643 issued Aug. 19, 1997 to Brian C. Price. These references are hereby incorporated in their entirety by reference.

In such processes a mixed refrigerant is used in a single heat exchange zone to achieve the desired cooling to liquefy the natural gas.

Other systems, which have been used, are referred to frequently as cascade systems, One such system is shown in U.S. Pat. No. 3,855,810 issued Dec. 24, 1974 to Simon, et al. This reference is also incorporated in its entirety by reference. Such processes utilize a plurality of refrigerant zones in which refrigerants of decreasing boiling points are vaporized to produce a coolant. In such systems, the highest boiling refrigerant, alone or with other refrigerants, is typically compressed, condensed and separated for cooling in a first refrigeration zone. The compressed cool, highest boiling point refrigerant is then flashed to provide a cold refrigerant stream which is used to cool the compressed, highest boiling point refrigerant in the first refrigeration zone. In the first refrigeration zone some of the lower boiling refrigerants may also be cooled and subsequently condensed and passed to vaporization to function as a coolant in a second or subsequent refrigeration zone and the like. As a result, the compression is primarily of the highest boiling refrigerant.

The composition of the natural gas liquids can vary widely from one natural gas source to another. In both types of processes, it is necessary to remove heavier natural gas liquids ($C_5$ +) from the natural gas to prevent plugging of the heat exchange passageways for the natural gas. Also it is often desirable in some instances to recover lighter hydrocarbons, such as $C_2$, $C_3$ and $C_4$. It is often desirable to recover the $C_2$, $C_3$, and $C_4$ hydrocarbons along with the heavier hydrocarbons since they may be more valuable as a separate product or as a part of the natural gas liquids, than as a portion of the LNG. In all instances, however, if substantial quantities of heaver natural gas liquids are present in the natural gas passed to the natural gas liquefaction zone, they freeze in the heat exchange passageways in the refrigerant zone at the liquefaction temperatures and plug the passageways.

In many instances, the natural gas is available at relatively high pressures, i.e., up to and possibly above about 1500 psig. It is much more efficient to liquefy the natural gas at elevated pressure than at lower pressure. Unfortunately the separation of the natural gas liquids and the remaining components of the natural gas stream requires that the pressure of the natural gas stream be reduced to a pressure below about 650 psig to achieve efficient separation of the methane from the remaining components of the natural gas. This results in the return of the natural gas after demethanation to the heat exchange passageways through the refrigeration section at a lower pressure, thereby resulting in liquefaction at the lower pressure. As indicated previously, it is more efficient to liquefy the natural gas at an elevated pressure.

Accordingly, more efficient methods have been sought for removing natural gas liquids from high-pressure natural gas streams without the loss of pressure so that the natural gas can be liquefied at elevated pressure.

SUMMARY OF THE INVENTION

According to the present invention, an improved process for efficiently liquefying a natural gas stream having a pressure greater than about 500 psig in a mixed refrigerant process to produce a liquefied natural gas stream is provided. The process comprises cooling the natural gas stream in a heat exchanger in the mixed refrigerant process to a first temperature less than about −40° F. to produce a cooled natural gas stream; passing the cooled natural gas stream to a liquid separation zone to produce a first gas stream and a first liquids stream; passing the first liquids stream to a methane separation tower at a temperature less than about −40° F. and at a pressure less than about 650 psig to produce a second gas stream containing at least fifty percent methane and a second liquids stream containing natural gas liquids; passing the first gas stream to a turbo expander to reduce the pressure of the first gas stream to a pressure less than about 650 psig to produce a reduced pressure gas stream and passing the reduced pressure gas stream to the methane separation tower; driving a compressor with the turbo expander; passing the second gas stream to the compressor and compressing the second gas stream to a pressure of at least about 500 psig to produce a compressed gas stream; and, passing the compressed gas stream to the heat exchanger for liquefaction at a pressure of at least about 500 psig to The present invention further comprises a process for liquefying a natural gas stream having a pressure greater than about 500 psig in a natural gas liquefaction process to produce a liquefied natural gas stream. The process comprises cooling the natural gas stream in a heat exchanger to a first temperature less than about −40° F. to produce a cooled natural gas stream; passing the cooled natural gas stream to a liquid separation zone to produce a first gas stream and a first liquids stream; passing the first liquids stream to a methane separation tower at a temperature less than about −40° F. and at a pressure less than about 650 psig to produce a second gas stream containing at least fifty percent methane and a second liquids stream containing natural gas liquids; passing the first gas stream to a turbo expander to reduce the pressure of the first gas stream to a pressure less than about 650 psig to produce a reduced pressure gas stream and passing the reduced pressure gas stream to the methane separation tower; driving a compressor with the turbo expander; passing the second gas stream to the compressor and compressing the second gas stream to a pressure of at least about 500 psig to produce a compressed gas stream; and, passing the compressed gas stream to the heat exchanger for liquefaction at a pressure of at least about 500 psig to produce the liquefied natural gas.

The invention further comprises a system for liquefying a natural gas stream having a pressure greater than about 500 psig, the system comprising: a refrigeration unit adapted to cool the natural gas to a temperature sufficient to liquefy at least a major portion of the natural gas, the refrigeration unit having an intermediate gas outlet, an intermediate gas inlet and a product liquefied natural gas outlet; a separator in fluid communication with the intermediate gas outlet and having a gas outlet and a liquids outlet; a methane separator in fluid communication with the liquids outlet and having an overhead gas outlet, a bottom liquid outlet and a gas inlet; a turbo expander in fluid communication with the gas outlet from the separator and the gas inlet to the methane separator; and, a compressor driven by the turbo expander and in fluid communication with the overhead gas outlet and having a compressed gas outlet in fluid communication with the intermediate gas inlet.

The invention further comprises a process for efficiently separating natural gas liquids from a natural gas stream at a pressure greater than about 500 psig to produce a high pressure gas stream and a natural gas liquid stream by cooling the natural gas stream to a first temperature less than about −40° F. to produce a cooled natural gas stream; passing the cooled natural gas stream to a liquid separation zone to produce a first gas stream and a first liquids stream; passing the first liquids stream to a methane separation tower at a pressure less than about 650 psig to produce a second gas stream containing at least fifty percent methane and a second liquids stream containing natural gas liquids; passing the first gas stream to a turbo expander to reduce the pressure of the first gas stream to a pressure less than about 650 psig to produce a reduced pressure gas stream and passing the reduced pressure gas stream to the methane separation tower; driving a compressor with the turbo expander; and, passing the second gas stream to the compressor and compressing the second gas stream to produce a high pressure compressed gas stream.

DESCRIPTION OF THE PREFERRED EMBODIMENTS

In the discussion of the Figures, the same numbers will be used throughout to refer to the same or similar components. Further, not all pumps, valves and the like required to achieve the desired flows have been shown for simplicity.

Figure 1:
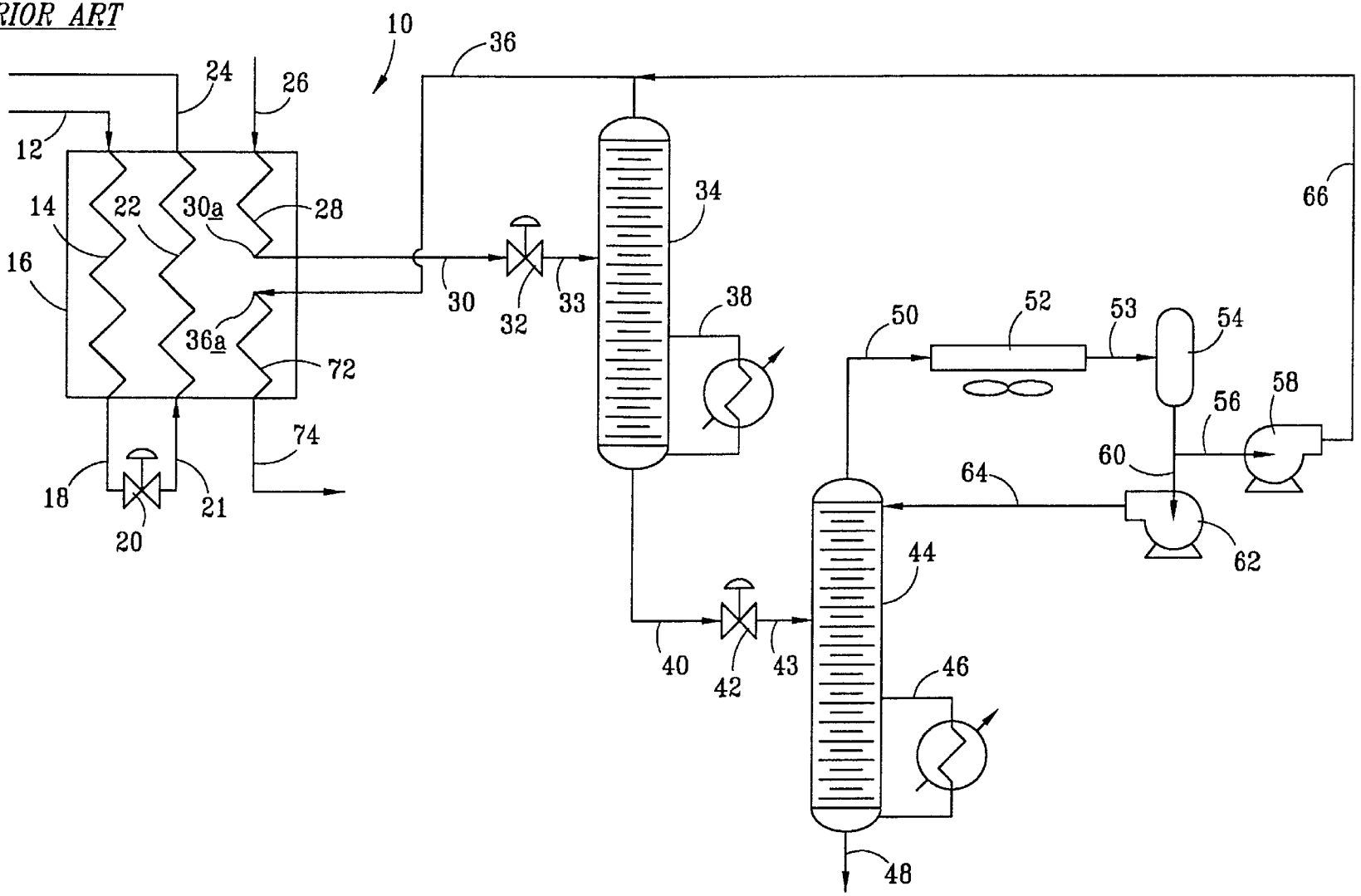
FIG. 1 PRIOR ART
FIG. 1 is a schematic diagram of a prior art process for liquefying natural gas.

In FIG. 1 a prior art natural gas liquefaction process 10 is shown. The process shown is a mixed refrigerant process such as shown in U.S. Pat. Nos. 4,033,735 and 5,657,643, previously incorporated by reference. A mixed refrigerant at about 80 to about 100° F., and typically about 100° F., and at a pressure of about 500 to about 600 psig, typically about 550 psig, is passed via a line 12 into a main heat exchanger 16 where it passes through a heat exchange passageway 14 to cool the mixed refrigerant. The cooled mixed refrigerant is typically recovered at a temperature of about −260° F., at a pressure from about 500 to about 600 psig, through a line 18 from which it is passed through an expansion valve 20 to further reduce the temperature of the mixed refrigerant which is substantially completely liquid in line 18 so that the mixed refrigerant begins to vaporize in line 21 as it passes upwardly through a heat exchange passageway 22. As the mixed refrigerant leaves heat exchange passageway 22, it has become substantially vaporized and it is at a temperature from about 50 to about 80° F. at a pressure from about 40 to about 50 psig.

The natural gas is passed via a line 26 into main heat exchanger 16 via a heat exchange passageway 28. Heat exchange passageway 28 has an intermediate natural gas outlet 30a via a line 30. The natural gas is removed via line 30 and passed via a valve 32 and a line 33 to a demethanizer tower 34. Demethanizer tower 34 is shown as a column including a plurality of valve trays or packing for the effective separation of methane from liquid components of the natural gas stream. The stream withdrawn through line 30 is typically at a temperature from about −40 to about −120° F. and may be at a pressure from about 200 to about 1500 psig. The pressure is desirably lowered to less than about 650 psig to remove the methane in the demethanizer tower.

The removal of the methane must be conducted at pressures below about 650 psig due to critical pressure considerations. The gas stream recovered from demethanizer tower 34 in line 36 contains at least 50 percent methane and is passed via a line 36 back to a heat exchange passageway 72 in main heat exchanger 16. The methane gas is then liquefied in heat exchange passageway 72 and produced as a liquid natural gas product through a line 74. As well known to those skilled in the art, the LNG produced through line 74 may be passed to flashing and the like to further reduce the temperature prior to storage. Typically the stream in line 74 is at a temperature from about −230 to about −275° F. at about one atmosphere. Wide variations are possible within the operation of the natural gas liquefaction process.

Demethanizer tower 34 is operated by the use of a re-boiler 38 to produce the heat required for the desired separation. Demethanizer tower 34 desirably operates at an overhead temperature from about −100 to about −150° F. and at a pressure less than about 650 psig. A liquid stream is produced via a line 40 as a bottom stream from demethanizer tower 34 and is passed via a valve 42 and a line 43 to a fractionator tower 44. Fractionator tower 44 is typically operated at an overhead temperature from about −10 to about 125° F. and at a pressure from about 250 to about 450 psig. Fractionator tower 44 also includes a re-boiler loop 46 and separates the stream in line 40 into a bottom stream which is a natural gas liquids stream which is typically produced as a product stream having desired specifications.

The overhead stream recovered through a line 50 is light gas, which is suitably recombined with the gas in line 36. To accomplish this, the gas in line 50 is cooled in a cooler 52 and passed via a line 53 to a liquid separator 54. Substantially all of the gas in line 50 is eventually liquefied and passed either via a line 60 and a pump 62 to recycle via a line 64 to fractionator tower 44 or via a line 56 and a pump 58 to a recycle line 66 through which it is passed to combination with the stream in line 36. The pump increases the pressure of the liquid to a suitable pressure so that it is readily combined with the gaseous stream in line 36.

Natural gas is typically available to such processes at a pressure from about 200 to about 1500 psig or higher. Since it is much more efficient to liquefy the natural gas at elevated pressure, it is highly undesirable that the process for the removal of natural gas liquids result in lowering the pressure to a pressure below about 500 psig. Nevertheless, such processes have typically been used since it is necessary to remove the heaver natural gas liquids ($C_5$ +) to prevent their freezing and plugging the heat exchange passageways in the main heat exchanger 16 and because the natural gas liquids typically have a higher value per unit of volume or weight than does the liquefied natural gas.

Figure 2:
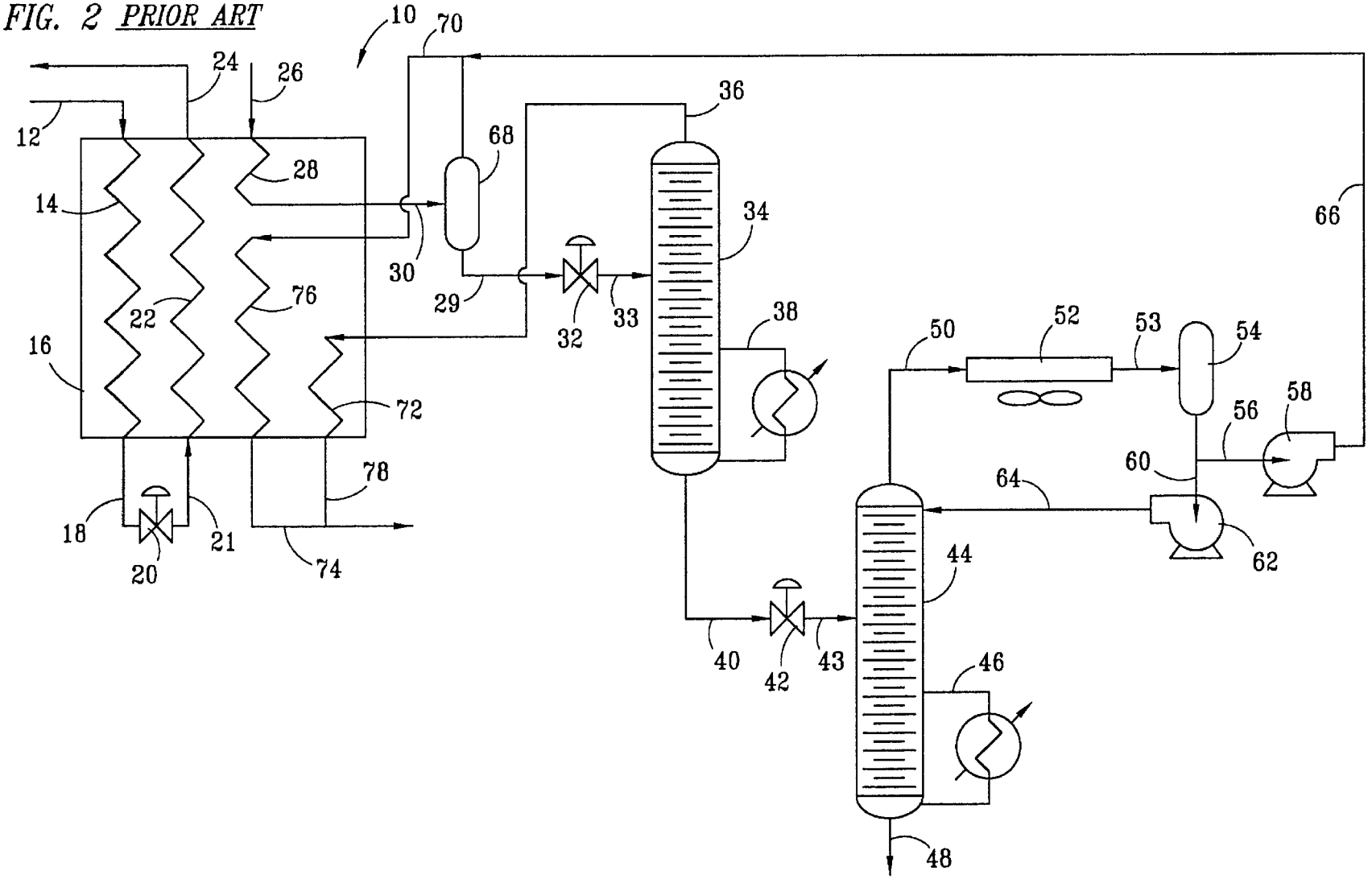
FIG. 2 PRIOR ART
FIG. 2 is a schematic diagram of a prior art process for liquefying natural gas.

In FIG. 2, an alternate prior art embodiment is shown wherein a liquid gas separator 68 is used to separate methane and other like gas components from the partially liquefied natural gas passed to separator 68 via line 30. The overhead gaseous stream in a line 70 is returned with the liquids from line 66 back to heat exchange passageway 76 at substantially the pressure of the inlet natural gas stream. The liquids from separator 68 are passed via a line 29, a valve 32 and a line 33 to demethanizer tower 34. The same separation discussed previously occurs in demethanizer tower 34 with the gaseous stream being recovered via a line 36 and passed back to a heat exchange passageway 72. The liquefied natural gas produced in heat exchange passageway 72 is liquidfied at a lower pressure and is recovered via a line 78 at substantially the same temperature as the liquefied natural gas recovered through line 74 and passed to flashing, to product and the like.

In both of these embodiments, it is necessary to reduce the pressure of the natural gas stream to a pressure below 650 psig in order to separate the methane and lighter 5 hydrocarbon components of the natural gas from the natural gas liquids. As a result, more horsepower is required for the added heat exchange requirement to liquefy the natural gas at the reduced pressure. It would be highly desirable if the pressure of the natural gas could be retained so that the liquefaction process could proceed more efficiently at a higher pressure.

Figure 3:
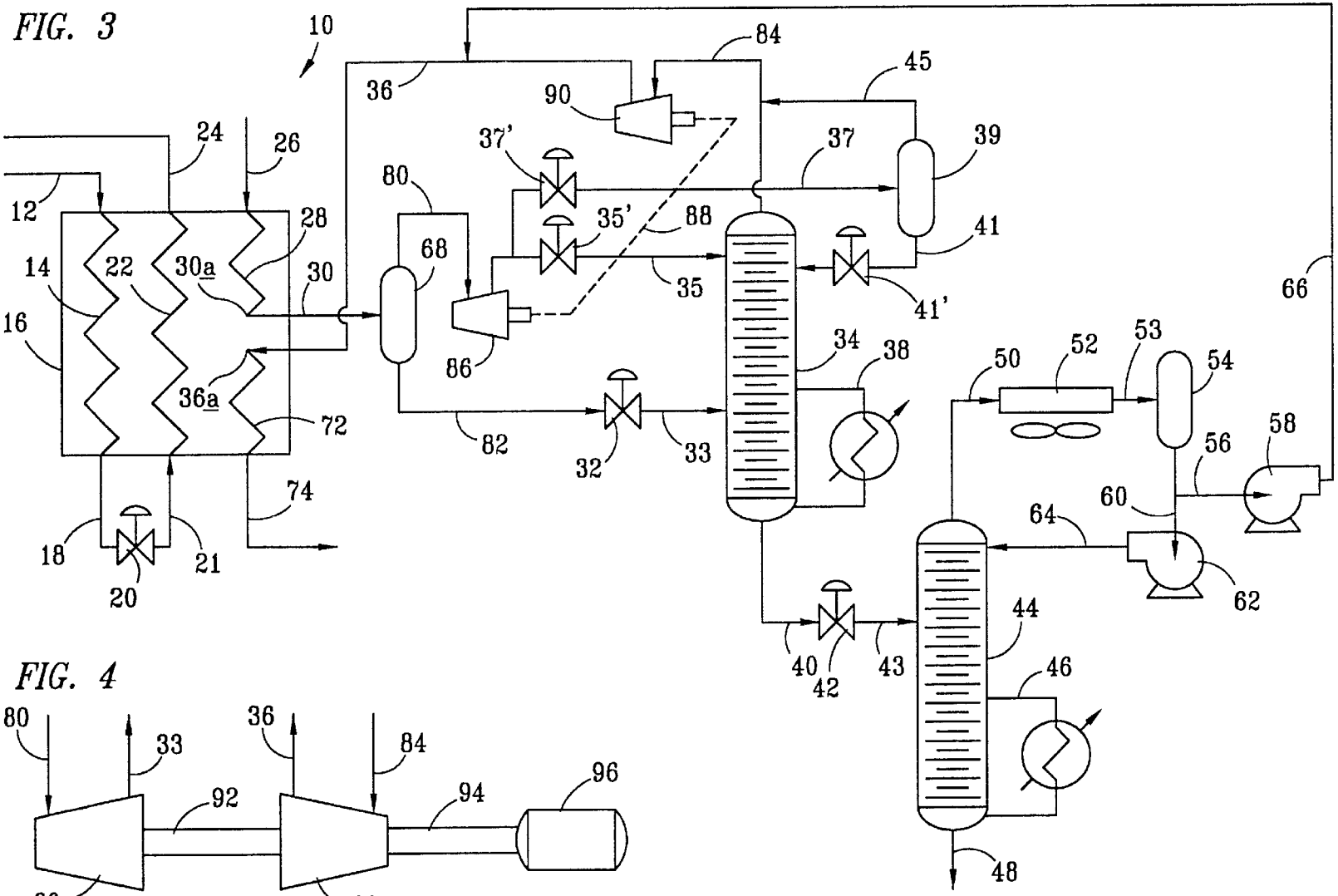
FIG. 3 is a schematic diagram of an embodiment of the process of the present invention; and, FIG. 4 is a schematic diagram of an embodiment of the turbo expander and compressor useful in the present invention.

In FIGS. 1, 2, and 3, the demethanizer tower 34 and fractionator tower 44 are shown as valve tray towers. Any suitable tower effective to separate materials having different boiling points, such as a pucket tower, could be used. The operation of these towers is not described in detail since the use of re-boilers and towers of this type to separate materials of different boiling points is well known to those skilled in the art.

In FIG. 3 an embodiment of the present invention is shown. In this embodiment, a stream is withdrawn from an intermediate natural gas outlet 30*a* from heat exchange passageway 28 via line 30 and passed to a separator 68. In separator 68 a gaseous stream 80 is withdrawn and passed to a turbo expander 86. In turbo expander 86 the pressure of the natural gas stream in line 80 is reduced to a pressure below about 650 psig. This stream is then passed to demethanizer tower 34 via a line 35 and a valve 35. The liquids recovered from separator 68 are also passed to demethanizer tower 34 via a line 82, valve 32 and line 33.

Alternatively the stream in line 35 may be passed, by closing valve 35' into a line 37 and via line 37 and a valve 37' to a separator 39. In separator 39 light hydrocarbons are separated and passed to line 84 for compression in a compressor 90. The liquids removed in separator 39 are passed via a line 41 and a valve 41' to demethanizer tower 34. This alternative may be used to relieve the separation load in the upper portion of demethanizer tower 34 resulting from passing large quantities of gas to the upper portion of demethanizer tower 34 via line 35.

Figure 4:
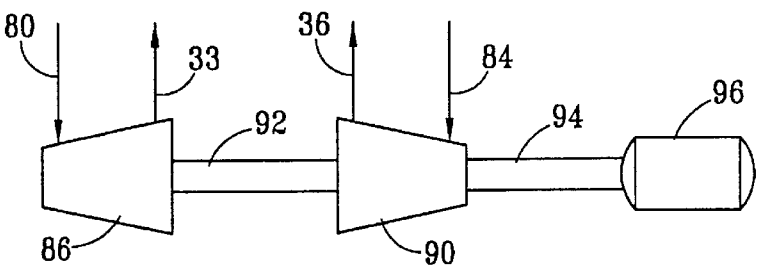

In either case the separation in demethanizer tower 34 proceeds as described previously with the overhead stream being recovered through a line 84 and passed to compressor 90 which is driven, at least partially, by turbo expander 86. These units are desirably shaft linked so that turbo expander 86 can drive compressor 90. The compressed gas leaving compressor 90 passes through line 36 back to a natural gas inlet 36*a* into heat exchange path 72. Liquefied natural gas is then produced through line 74 as discussed previously. The higher pressure in line 36 permits liquefaction of the natural gas at a higher pressure, typically above about 500 psig. Liquefaction of the natural gas at elevated pressure permits the production of LNG at a higher temperature and reduces the LNG process power requirements. In FIG. 4 turbo expander 86 is shown shaft coupled by a shaft 92 to compressor 90 to compress natural gas in line 84 from demethanizer tower 34. The compressed gas is discharged as shown via a line 36. Compressor 90 may be driven solely by turbo expander 86, and in this embodiment enables the recovery of a major portion of the compression energy lost in the natural gas stream by the reduction of pressure required for demethanizer tower 34. The compression energy is recovered in compressor 90 wherein the gas stream produced as an overhead stream in demethanizer tower 34 is compressed by compressor 90. There is some lost pressure in the resulting natural gas stream returned to heat exchange passageway 72 by comparison to the inlet gas stream when turbo expander 86 is used as the only source of power for compressor 90. Nevertheless, the gas is still liquefied at a pressure substantially higher than can be achieved when the product stream from demethanizer tower 34 is passed directly into heat exchange passageway 72.

In the event that it is desired to increase the pressure to a higher level than possible when only turbo expander 86 is used as a power source, it is possible to supplement turbo expander 86 as a power source by shaft coupling a motor 96 via a shaft 94 or the like to compressor 90 to increase the pressure of the gas stream in line 36. This permits the liquefaction of the natural gas at a higher pressure as desired. The amount of power supplied by motor 96 can be widely varied and is dependent upon a variety of factors such as the required horse power for refrigerant compression, the desired liquefaction pressure and the like. The motor used is a conventional motor, which is desirably an electrical motor, and both turbo expander 86 and motor 96 are coupled to compressor 90 by conventional coupling systems. Such systems are well known to those skilled in the art and will not be discussed further.

Desirably the natural gas liquids are produced through line 48 to specifications for the natural gas liquid stream. The overhead stream in line 50 is allowed to vary as necessary to produce the desired specification product stream in line 48. Alternatively, a product stream may be recovered via line 40, which contains not only the natural gas liquids, but quantities of lighter hydrocarbons as well. It may be desirable in some instances to utilize this stream as a product stream.

The process may readily be varied as desired to produce natural gas liquids as individual components of the natural gas liquids or as a combined natural gas liquid stream or the like. Such variations will depend upon the economic situation applicable to the particular installation. In any event, the process of the present invention is directed to returning the light gaseous components of the natural gas stream to the refrigeration passageway in heat exchanger 16 at a pressure higher than is normally recovered from demethanizer 34. This results in increased efficiency in the main heat exchanger and improved overall process efficiency.

While the present invention has been discussed above with respect to mixed refrigerant processes, it is equally useful with cascade processes or other processes since these processes also require that the heavier natural gas liquids be removed from the natural gas prior to cooling to its liquefaction temperature. Similar considerations apply in that the natural gas liquids may be more valuable as a separate product than as a part of the LNG and that the heavy ($C_5$ +) constituents of the natural gas stream tend to freeze in the refrigeration passageway unless removed. Both processes offer the flexibility to cool the natural gas to an intermediate temperature prior to removal of the natural gas liquids, and the flexibility to further cool the remaining components of the natural gas after removal of the natural gas liquids to a liqueifaction temperature.

Many natural gas sources produce natural gas at pressures from 200 to about 1500 psig or higher. This natural gas is desirably liquefied at the elevated pressures, i.e., above about 500 psig. As indicated above, in prior art processes, the pressure of the natural gas stream is required to be reduced to a pressure below about 650 psig to remove the natural gas liquids from the natural gas. This reduction in pressure is primarily required as a result of critical pressure considerations in the demethanizer. As a result, it is required in substantially all demethanization processes.

According to the present invention, the gas pressure energy is recovered and utilized to recompress the demethanizer product gas for return to the refrigeration section. This results in a greatly reduced loss of pressure in the process used to remove the natural gas liquids from the natural gas stream.

Having thus described the invention by reference to certain of its preferred embodiments, it is noted that the embodiments described are illustrative rather than limiting in nature and that many variations and modifications are possible within the scope of the present invention.

Having thus described the invention, I claim:

1. A process for liquefying a natural gas stream having a pressure greater than about 500 psig in a mixed refrigerant process to produce a liquefied natural gas product, the method comprising:

a) cooling the natural gas stream in a heat exchanger in the mixed refrigerant process to a first temperature less than about −40_F. to produce a cooled natural gas stream;

b) passing the cooled natural gas stream to a liquids separation zone to produce a first gas stream and a first liquids stream;

c) passing the first liquids stream to a methane separation tower at a temperature less than about −40° F. and at a pressure less than about 650 psig to produce a second gas stream comprising methane and a second liquids stream containing natural gas liquids;

d) passing the first gas stream to a turbo expander to reduce the pressure of the first gas stream to a pressure less than about 650 psig to produce a reduced pressure gas stream and passing the reduced pressure gas stream to the methane separation vessel;

e) driving a compressor with the turbo expander;

f) passing the second gas stream to the compressor and compressing the second gas stream to a pressure of at least about 500 psig to produce a compressed gas stream; and, g) passing the compressed gas stream to the heat exchanger for liquefaction at a pressure of at least about 500 psig to produce the liquefied natural gas.

2. The method of claim 1 wherein the first temperature is from about −40 to about −120° F.

3. The method of claim 1 wherein the first liquids stream is passed to the methane separation tower at a temperature from about −40 to about −120° F.

4. The method of claim 1 wherein the methane separation tower has an overhead temperature from about −100 to about −150° F. and operatesat a pressure less than about 650 psig.

5. The method of claim 1 wherein the second liquid stream is passed to a fractionator to produce a third gas stream and a stream comprising natural gas liquids.

6. The method of claim 5 wherein the third gas stream is cooled, liquefied and pumped to combination with the compressed gas stream.

7. The method of claim 1 wherein the compressor is also driven by a motor.

8. The method of claim 1 wherein the reduced pressure gas stream is passed to a second separation zone to produce a third gas stream and a third liquid stream with the third gas stream being passed to the compressor and the third liquid stream being passed to the methane separation tower.

9. A process for liquefying a natural gas stream having a pressure greater than about 500 psig in a natural gas liquefaction process to produce a liquefied natural gas product, the process comprising:

a) cooling the natural gas stream in a heat exchanger in the natural gas liquefaction process to a first temperature less than about −40° F. to produce a cooled natural gas stream;

b) passing the cooled natural gas stream to a liquids separation zone to produce a first gas stream and a first liquids stream;

c) passing the first liquids stream to a methane separation tower at a temperature less than about −40° F. and at a pressure less than about 650 psig to produce a second gas stream comprising methane and a second liquids stream containing natural gas liquids;

d) passing the first gas stream to a turbo expander to reduce the pressure of the first gas stream to a pressure less than about 650 psig to produce a reduced pressure gas stream and passing the reduced pressure gas stream to the methane separation tower;

e) driving a compressor with the turbo expander;

f) passing the second gas stream to the compressor and compressing the second gas stream to a pressure of at least about 500 psig to produce a compressed gas stream; and, g) passing the compressed gas stream to the heat exchanger for liquefaction at a pressure of at least about 500 psig to produce the liquefied natural gas.

10. The method of claim 9 wherein the first temperature is from about −40 to about −120° F.

11. The method of claim 9 wherein the first liquids stream is passed to the methane separator at a temperature from about −40 to about −120° F.

12. The method of claim 9 wherein the methane separator is at a temperature from about −100 to about −120° F. and at a pressure less than about 650 psig.

13. The method of claim 9 wherein the second liquid stream is passed to a fractionator to produce a third gas stream and a stream comprising natural gas liquids.

14. The method of claim 13 wherein the third gas stream is cooled, liquefied and pumped to combination with the compressed gas stream.

15. The method of claim 9 wherein the compressor is also driven by a motor.

16. The method of claim 9 wherein the reduced pressure gas stream is passed to a second separative zone to produce a third gas stream and a third liquid stream with the third gas stream being passed to the compressor and the third liquid stream being passed to the methane separation tower.

17. A system for liquefying a natural gas stream having a pressure greater than about 500 psig, the system comprising:

a) a refrigeration unit adapted to cool the natural gas to a temperature sufficient to liquefy at least a major portion of the natural gas, the refrigeration unit having an intermediate gas outlet, an intermediate gas inlet and a product liquefied natural gas outlet;

b) a separator in fluid communication with the intermediate gas outlet and having a gas outlet and a liquids outlet;

c) a methane separator tower in fluid communication with the liquids outlet and having an overhead gas outlet, a bottom liquid outlet and a gas inlet;

d) a turbo expander in fluid communication with the gas outlet from the separator and the gas inlet to the methane separator tower; and, e) a compressor driven by the turbo expander and in fluid communication with the overhead gas outlet and having a compressed gas outlet in fluid communication with the intermediate gas inlet.

18. The system of claim 17 wherein the system further comprises a fractionator in fluid communication with the bottom liquid outlet and having a separated gas outlet and a natural gas liquids outlet.

19. The system of claim 18 wherein the separated gas outlet is in fluid communication via a heat exchanger, a pump and a line with the intermediate gas inlet.

20. The system of claim 17 wherein the refrigeration unit comprises a plurality of heat exchange zones.

21. A process for efficiently separating natural gas liquids from a natural gas stream at a pressure greater than about 500 psig to produce a high pressure gas stream and a natural gas liquids stream, the process comprising:

a) cooling the natural gas stream to a first temperature less than about −40° F. to produce a cooled natural gas stream;

b) passing the cooled natural gas stream to a liquids separation zone to produce a first gas stream and a first liquids stream;

c) passing the first liquids stream to a methane separation vessel at a temperature less than about −40° F. and at a pressure less than about 650 psig to produce a second gas stream comprising methane and a second liquids stream containing natural gas liquids;

d) passing the first gas stream to a turbo expander to reduce the pressure of the first gas stream to a pressure less than about 650 psig to produce a reduced pressure gas stream and passing the reduced pressure gas stream to the methane separation tower;

e) driving a compressor with the turbo expander; and, f) passing the second gas stream to the compressor and compressing the second gas stream to produce a high pressure compressed gas stream.

22. The process of claim 21 wherein the second liquid stream is passed to a fractionator to produce a third gas stream and a stream comprising natural gas liquids.

23. The method of claim 21 wherein the reduced pressure gas stream is passed to a second separation zone to produce a third gas stream and a third liquid stream with the third gas stream being passed to the compressor and the third liquid stream being passed to the methane separation tower.

* * * * *